US010274137B1

(12) United States Patent
Chiu et al.

(10) Patent No.: US 10,274,137 B1
(45) Date of Patent: Apr. 30, 2019

(54) LAMP ASSEMBLY AND LAMP USING THE LAMP ASSEMBLY

(71) Applicant: Beautiful Light Technology Corp., Chiayi (TW)

(72) Inventors: Shih-Ting Chiu, Chiayi (TW); Chien-Wen Chiu, Chiayi (TW)

(73) Assignee: Beautiful Light Technology Corp., Chiayi (TW)

( * ) Notice: Subject to any disclaimer, the term of this patent is extended or adjusted under 35 U.S.C. 154(b) by 0 days.

(21) Appl. No.: 15/901,865

(22) Filed: Feb. 21, 2018

(30) Foreign Application Priority Data

Nov. 22, 2017 (TW) ..... 106217369 U

(51) Int. Cl.

| | |
|---|---|
| ***F21V 23/06*** | (2006.01) |
| ***F21K 9/238*** | (2016.01) |
| ***F21K 9/66*** | (2016.01) |
| ***F21K 9/69*** | (2016.01) |
| ***F21V 29/70*** | (2015.01) |
| ***H01Q 1/44*** | (2006.01) |
| ***F21V 23/00*** | (2015.01) |
| *H01Q 1/22* | (2006.01) |

(52) U.S. Cl.
CPC ..... *F21K 9/238* (2016.08); *F21K 9/66* (2016.08); *F21K 9/69* (2016.08); *F21V 23/006* (2013.01); *F21V 23/06* (2013.01); *F21V 29/70* (2015.01); *H01Q 1/44* (2013.01); *H01Q 1/2291* (2013.01)

(58) Field of Classification Search
CPC ... F21K 9/238; F21K 9/66; F21K 9/69; F21V 29/70; F21V 23/006; F21V 23/06; H01Q 1/44
See application file for complete search history.

(56) References Cited

U.S. PATENT DOCUMENTS

| | | | | |
|---|---|---|---|---|
| 2004/0105264 | A1* | 6/2004 | Spero | B60Q 1/04 362/276 |
| 2013/0063317 | A1 | 3/2013 | Jonsson et al. | |
| 2013/0136454 | A1 | 5/2013 | Yu | |
| 2014/0021864 | A1* | 1/2014 | Liao | H01R 33/94 315/133 |

(Continued)

FOREIGN PATENT DOCUMENTS

| | | | |
|---|---|---|---|
| EP | 2730833 | A1 | 5/2014 |
| EP | 3165809 | A1 | 5/2017 |
| WO | 2013031043 | A1 | 3/2013 |

*Primary Examiner* — Anabel Ton

(74) *Attorney, Agent, or Firm* — CKC & Partners Co., LLC

(57) ABSTRACT

A lamp assembly and a lamp are provided. The lamp assembly includes a light source substrate, a circuit board and a lamp cover. The light source substrate includes a first surface, a second surface and plural light sources. The first surface is opposite to the second surface, and the light sources are disposed on the first surface. The circuit board is electrically connected to the light source substrate. A transmitting and receiving module is disposed on the circuit board, and the transmitting and receiving module has an antenna. A lamp cover covers the light sources. The lamp cover has an outer surface, an inner surface and a through hole. The inner surface is opposite to the outer surface, and the through hole extends from the inner surface to the outer surface. The antenna passes through the through hole and extends outside the outer surface of the lamp cover.

11 Claims, 5 Drawing Sheets

(56) References Cited

U.S. PATENT DOCUMENTS

| | | | | |
|---|---|---|---|---|
| 2015/0103515 | A1* | 4/2015 | Bosua | F21V 29/83<br>362/157 |
| 2015/0289349 | A1* | 10/2015 | Kim | F21K 9/23<br>315/34 |
| 2015/0327349 | A1* | 11/2015 | Lee | F21K 9/232<br>362/294 |

* cited by examiner

LAMP ASSEMBLY AND LAMP USING THE LAMP ASSEMBLY

RELATED APPLICATIONS

This application claims priority to Taiwan Application Serial Number 106217369, filed on Nov. 22, 2017, which is incorporated herein by reference.

BACKGROUND

Field of Invention

The present invention relates to a lamp assembly and its application. More particularly, the present invention relates to a lamp assembly with its antenna extending outside the lamp cover, and a lamp using the lamp assembly.

Description of Related Art

With the development of science and technology, intelligent lamps have become a development trend of the lamp industry. There is an intelligent lamp which is used to receive an outer control signal transmitted from a user so as to control the operation of other lamps.

However, an antenna used to receive the outer control signal is usually installed inside the lamp. Moreover, in order to achieve the purpose of heat dissipation, the casing/housing of a common lamp is made of metal, thus easily causing the antenna to be shielded and seriously affecting the receiving or transmitting function of the antenna.

SUMMARY

An object of the invention is to provide a lamp assembly and a lamp having the lamp assembly, in which an antenna of the lamp assembly has better receiving and transmitting function.

According to the aforementioned object, a lamp assembly is provided. The lamp assembly includes a light source substrate, a circuit board and a lamp cover. The light source substrate includes a first surface, a second surface and plural light sources, in which the first surface is opposite to the second surface, and the light sources are disposed on the first surface. The circuit board is electrically connected to the light source substrate, in which a transmitting and receiving module is disposed on the circuit board, and the transmitting and receiving module has an antenna. A lamp cover covers the light sources, in which the lamp cover has an outer surface, an inner surface and a through hole. The inner surface is opposite to the outer surface, and the through hole extends from the inner surface to the outer surface. The antenna passes through the through hole and extends outside the outer surface of the lamp cover.

According to the aforementioned object, a lamp is provided. The lamp includes a lamp cup and a lamp assembly. The lamp assembly includes a light source substrate, a circuit board and a lamp cover. The light source substrate includes a first surface, a second surface and plural light sources, in which the first surface is opposite to the second surface, and the light sources are disposed on the first surface. The circuit board is electrically connected to the light source substrate, in which a transmitting and receiving module is disposed on the circuit board, and the transmitting and receiving module has an antenna. A lamp cover covers the light sources, in which the lamp cover has an outer surface, an inner surface and a through hole. The inner surface is opposite to the outer surface, and the through hole extends from the inner surface to the outer surface. The antenna passes through the through hole and extends outside the outer surface of the lamp cover.

According to an embodiment of the present invention, the circuit board is disposed on the second surface of the light source substrate, and the antenna passes from the second surface to the first surface of the light source substrate and extends out from the first surface.

According to an embodiment of the present invention, the lamp cover further includes plural lens disposed on the inner surface of the lamp cover, and the lens are corresponding to the light sources.

According to an embodiment of the present invention, the lamp assembly further includes a fixing member. The fixing member is disposed on the outer surface of the lamp cover, in which the fixing member is configured to fix the antenna.

According to an embodiment of the present invention, the fixing member includes an extending portion and a positioning post. The extending portion is disposed parallel to the outer surface of the lamp cover, in which the extending portion has an accommodating slot, and the accommodating slot is configured to accommodate the antenna. The positioning post is vertically disposed on the extending portion, in which the positioning post is inserted into a positioning hole of the lamp cover.

According to an embodiment of the present invention, the lamp cover further includes a sealer, and the sealer is disposed in the through hole and covers a portion of the antenna located in the through hole.

According to an embodiment of the present invention, the transmitting and receiving module is a bluetooth module, a ZigBee module or a WiFi module.

According to an embodiment of the present invention, the lamp further includes a lamp adapter. The lamp adapter is disposed on a bottom end of the lamp cup, in which the lamp adapter is electrically connected to the circuit board.

According to the aforementioned embodiments of the present invention, the antenna of the present invention extends outside the lamp, thus preventing the antenna from being interfered by the lamp cup or other metal casing, so as to increase communication distance and communication effect. In addition, the fixing member can be used to position the antenna, so that the exterior appearance of the lamp can be kept unchanged when the antenna is disposed outside.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
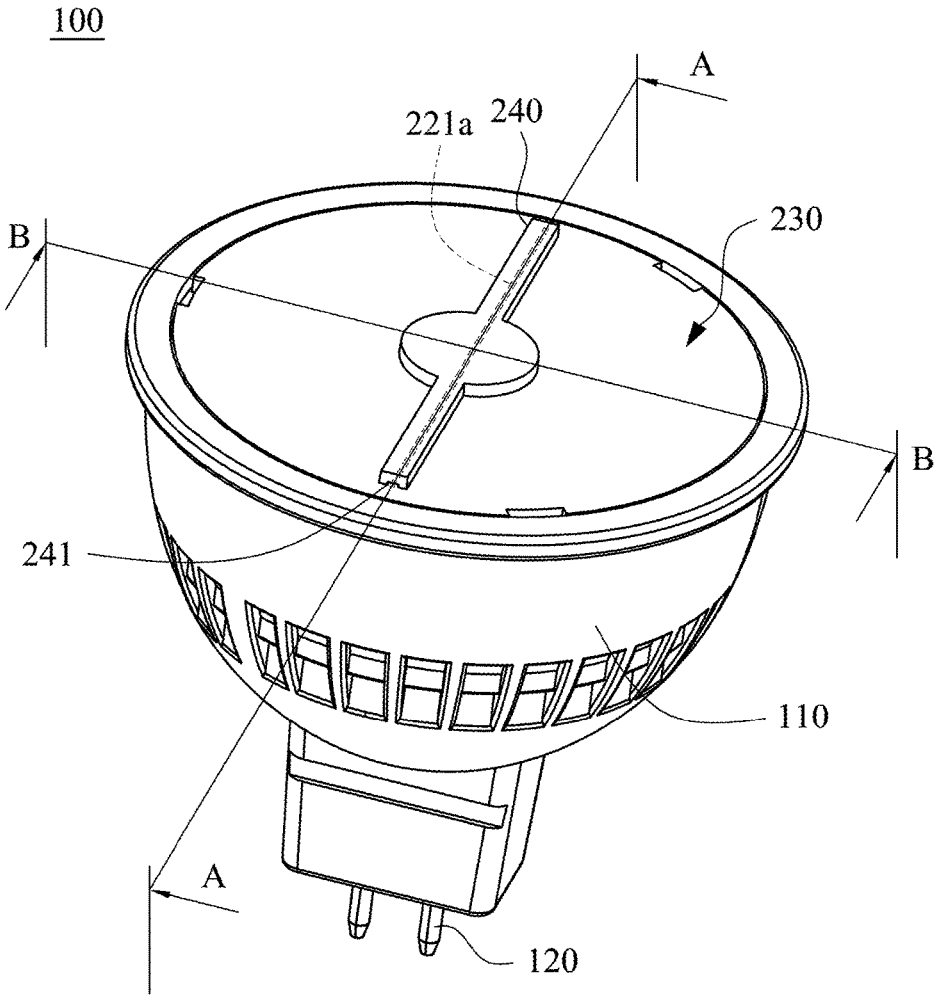
FIG. 1 is a schematic structural diagram showing a lamp in accordance with an embodiment of the present invention.
Figure 2:
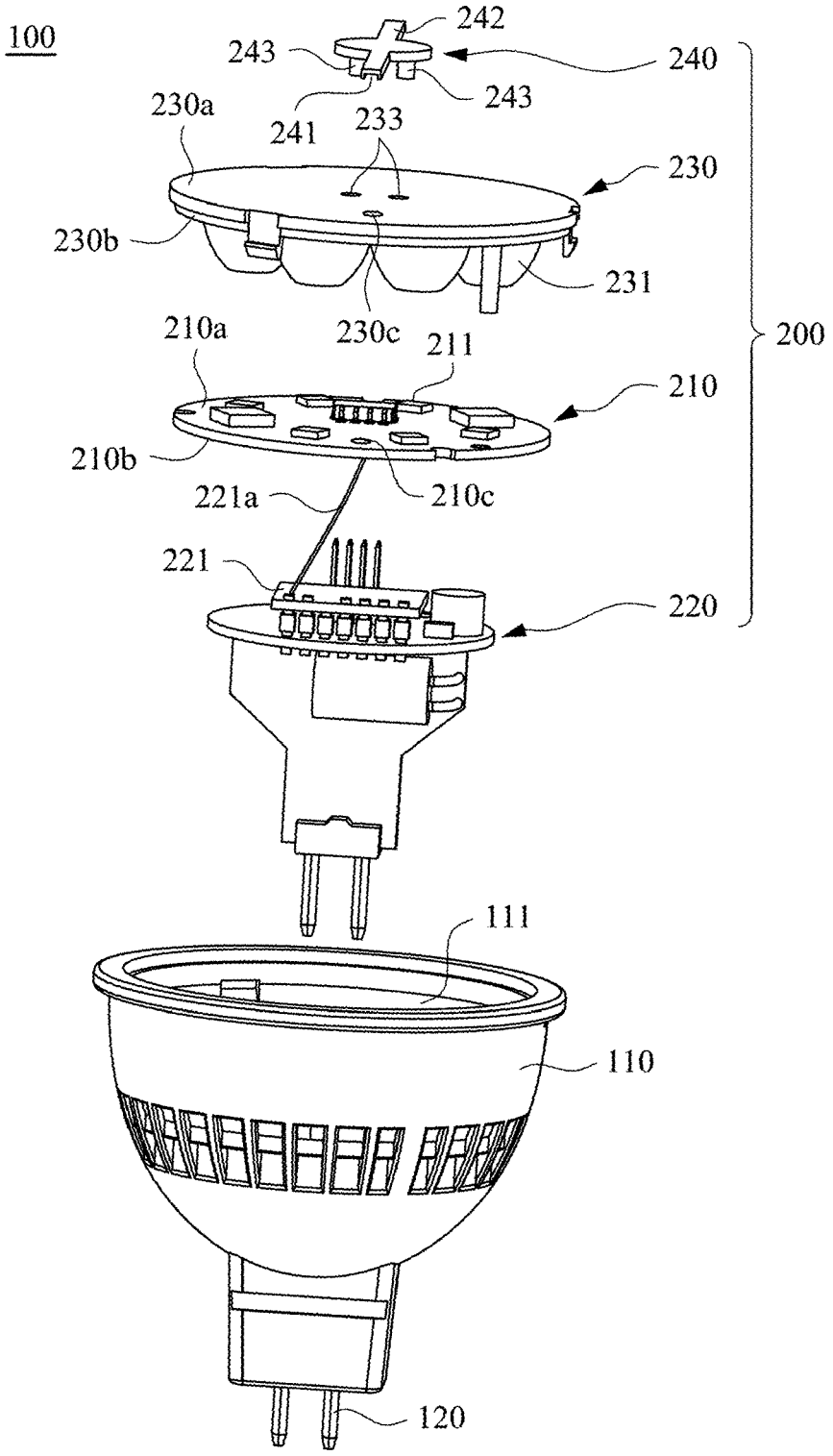
FIG. 2 is a schematic exploded view of the lamp in accordance with an embodiment of the present invention.

Referring to FIG. 1 and FIG. 2, FIG. 1 and FIG. 2 are a schematic structural diagram and a schematic exploded view showing a lamp 100 in accordance with an embodiment of the present invention. In the present embodiment, the lamp 100 mainly includes a lamp assembly 200, a lamp cup 110 and a lamp adapter 120. The lamp cup 110 has an accommodating space 111. In one example, the lamp cup 110 is made of metal having good heat dissipation ability.

The lamp assembly 200 mainly includes a light source substrate 210, a circuit board 220 and a lamp cover 230. The light source substrate 210 and the circuit board 220 are disposed in the accommodating space 111 of the lamp cup 110. The light source substrate 210 has a plurality of light sources 211. In one embodiment, the light source substrate 210 is an aluminum substrate, and the light sources 211 are light-emitting diodes. The circuit board 220 is electrically connected to the light source substrate 210 and can be used to control the operation of the light sources 211. As shown in FIG. 1 and FIG. 2, the lamp cover 230 is disposed on a top end of the lamp cup 110 and covers the accommodating space 111. The lamp adapter 120 is disposed on a bottom end of the lamp cup 110 and is electrically connected to the circuit board 220. The lamp adapter 120 is mainly used to be inserted into a light bulb socket to conduct electric power to the circuit board 220. In the present embodiment, the lamp adapter 120 is a plug-in-type structure, but the present invention is not limited thereto. In other embodiments, the lamp adapter 120 may be a screw-type lamp adapter or a bayonet-type lamp adapter.

Figure 3:
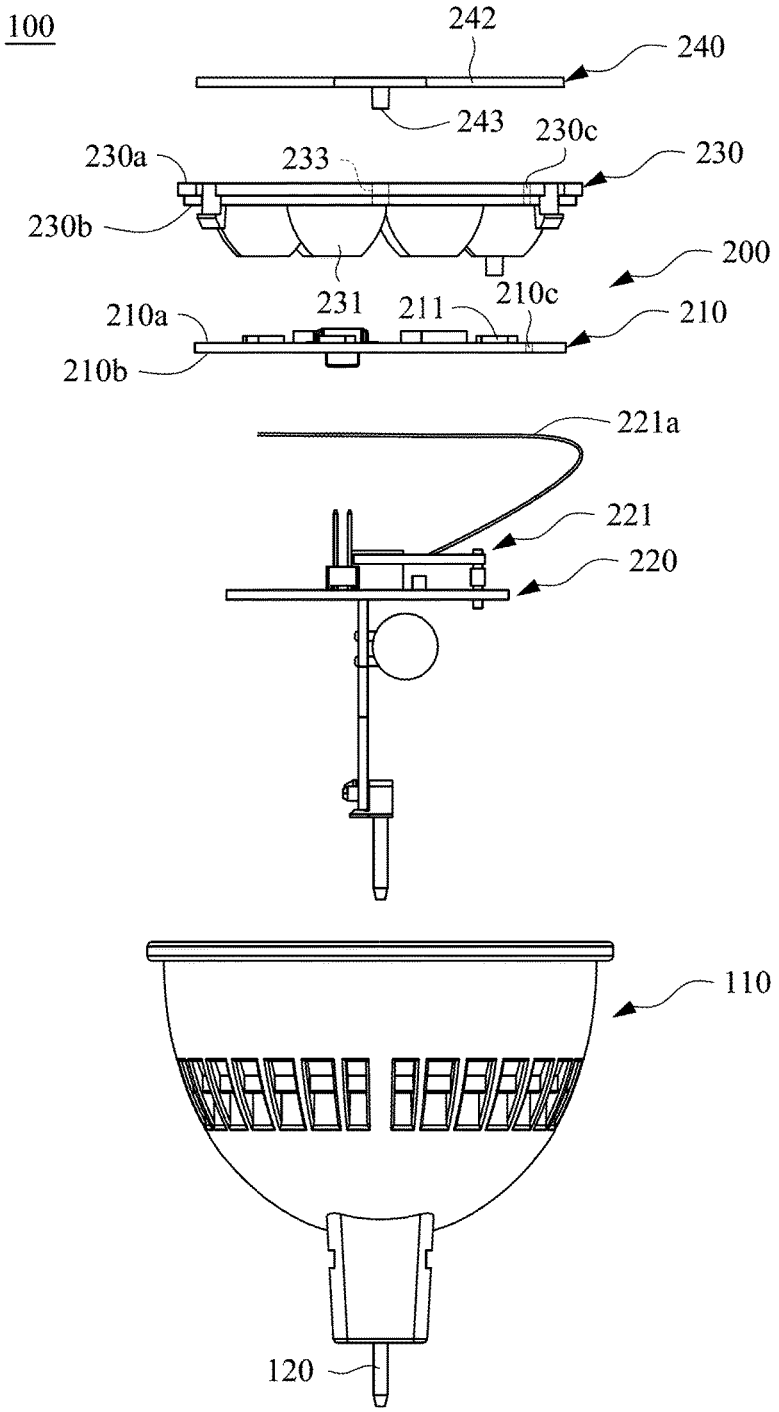
FIG. 3 is another schematic exploded view of the lamp in accordance with an embodiment of the present invention.

Simultaneously referring to FIG. 2 and FIG. 3, FIG. 3 is another schematic exploded view of the lamp in accordance with an embodiment of the present invention. In the present embodiment, a transmitting and receiving module 221 is disposed on the circuit board 220. The transmitting and receiving module 221 has an antenna 221*a*, and the antenna 221*a* extends outside the lamp cover 230. The transmitting and receiving module 221 is used to transmit or receive control signals from the outside via the antenna 221*a*, and the circuit board 220 is used to control the operation of the light sources 211 according to the control signals received by the transmitting and receiving module 221. In some embodiments, the transmitting and receiving module 221 may be a bluetooth module, a ZigBee module or a WiFi module.

As shown in FIG. 2 and FIG. 3, the light source substrate 210 has a first surface 210*a*, a second surface 210*b* and a through hole 210*c*. The first surface 210*a* is opposite to the second surface 210*b*, and the through hole 210*c* extends from the second surface 210*b* to the first surface 210*a*. In the present embodiment, the light sources 211 are disposed on the first surface 210*a* of the light source substrate 210, and the circuit board 220 is disposed on the second surface 210*b* of the light source substrate 210. In the present embodiment, the antenna 221*a* of the transmitting and receiving module 221 disposed on the circuit board 220 passes through the through hole 210*c* from the second surface 210*b* to the first surface 210*a* and extends from the first surface 210*a*. In addition, the lamp cover 230 has an outer surface 230*a*, an inner surface 230*b* and a through hole 230*c*. Plural lens 231 are disposed on the inner surface 230*b* and respectively corresponding to the light sources 211, so as to change the light shape of the light sources 211. The through hole 230*c* extends from the inner surface 230*b* to the outer surface 230*a*. In the present embodiment, the antenna 221*a* which extends from the first surface 210*a* passes through the through hole 230*c* from the inner surface 230*b* to the outer surface 230*a* of the lamp cover 230 and extends outward from the outer surface 230*a*.

Figure 4:
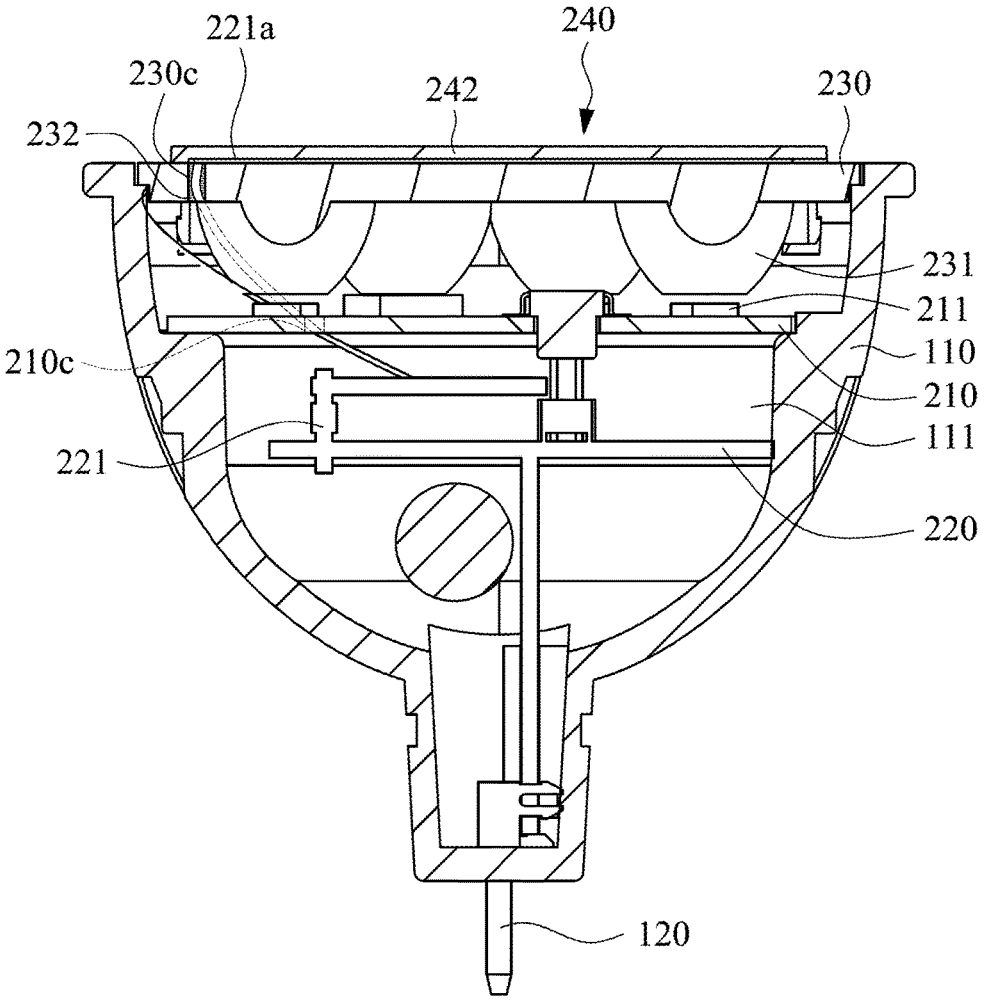
FIG. 4 is a schematic cross-sectional view taken along a line A-A in FIG. 1.

Simultaneously referring to FIG. 4, FIG. 4 is a schematic cross-sectional view taken along a line A-A in FIG. 1. Although both the circuit board 220 and the transmitting and receiving module 221 are disposed in the lamp cup 110, the antenna 221*a* of the transmitting and receiving module 221 penetrates the light source substrate 210 and the lamp cover 230 to extend outside the lamp cover 230. Therefore, singles transmitted or received by the antenna 221*a* will not be shielded by the lamp cup 110, thus enabling the antenna 221*a* to have good communication quality and good capability for long communication distance.

It is noted that, in the present embodiment, the circuit board 220 and the transmitting and receiving module 221 are disposed on the second surface 210*b* of the light source substrate 210, so that the antenna 221*a* of the transmitting and receiving module 221 firstly penetrates through the light source substrate 210, and then penetrates through the lamp cover 230, and further extends outside the lamp cover 230. In other embodiments, the circuit board 220 may be directly disposed on the first surface 210*a* of the light source substrate 210, or the circuit board 220 and the light source substrate 210 may be integrated into a single chip, so that the antenna 221*a* of the transmitting and receiving module 221 may directly penetrate the lamp cover 230 to extend outside the lamp cover 230 without penetrating the light source substrate 210, so as to achieve the aforementioned effect.

As shown in FIG. 4, in some embodiments, the lamp cover 230 further includes a sealer 232. The sealer 232 is disposed in the through hole 230*c* and covers a portion of the antenna 221*a* which located in the through hole 230*c*. In some examples, the sealer 232 may be a moisture proof sealer which is formed by filling the through hole 230*c* with glue. The sealer 232 is used to prevent outer moisture or dust from entering the inside of the lamp 100.

Figure 5:
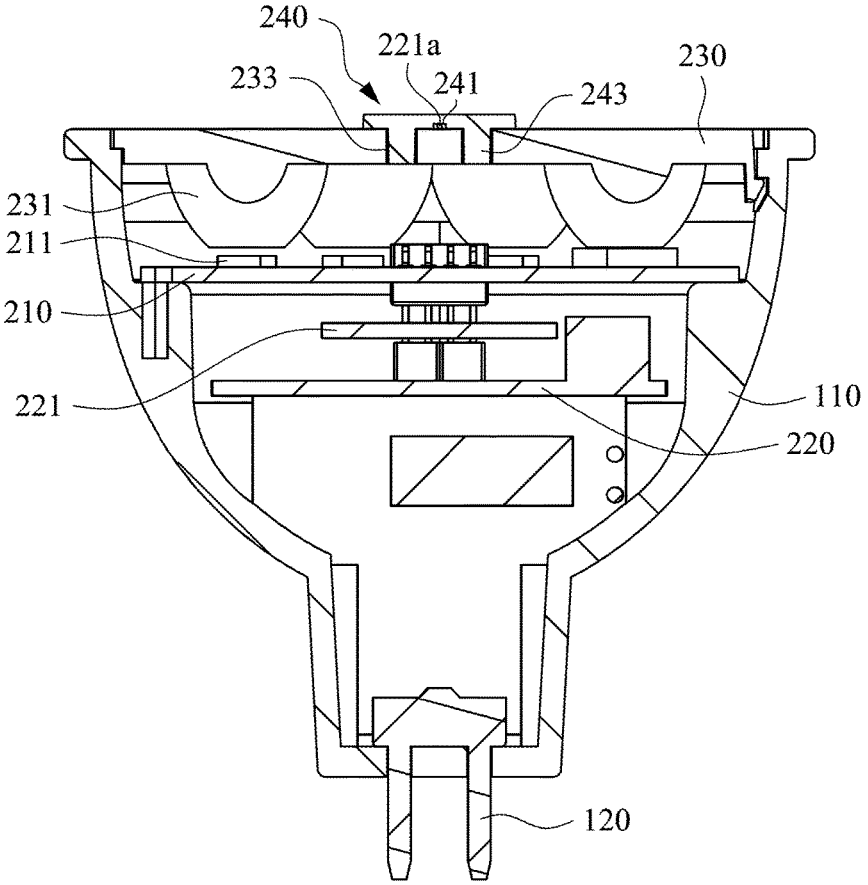
FIG. 5 is a schematic cross-sectional view taken along a line B-B in FIG. 1.

Simultaneously referring to FIG. 2, FIG. 4 and FIG. 5, FIG. 5 is a schematic cross-sectional view taken along a line B-B in FIG. 1. In some embodiments, the lamp assembly 200 further includes a fixing member 240. The fixing member 240 is configured to position a portion of the antenna 221*a* which extends outside the lamp cover 230. As shown in FIG. 2 and FIG. 4, the fixing member 240 includes an extending portion 242 and a positioning post 243. The extending portion 242 is parallel to the outer surface 230*a* of the lamp cover 230. The extending portion 242 has an accommodating slot 241, and the accommodating slot 241 is used to accommodate the antenna 221*a*. The positioning post 243 is vertical to the extending portion 242, and the positioning post 243 is configured to be inserted into a positioning hole 233 of the lamp cover 230, so as to position the antenna 221*a* on the outer surface 230*a* of the lamp cover 230. In other embodiments, the fixing member 240 may be an adhesive member, such as an adhesive tape, which also can be used to fix the antenna 221*a* on the outer surface 230*a* of the lamp cover 230. In some examples, the fixing member 240 is transparent or semi-transparent, or the material or the color of the fixing member 240 may be the same as the material or the color of the lamp cover 230, so that light-emitting effect of the lamp 200 will not be affected when the fixing member 240 is disposed on the lamp cover 230.

Referring to the following Table 1, Table 1 shows comparison results of testing data respectively measured from lamps without the design of the present invention in comparison with lamps having the design of the present invention. It can be known from Table 1, by applying the present invention to three types of conventional lamps, the communication distance of the antenna of each conventional lamp is substantially increased.

TABLE 1

| testing data | first type of lamp | second type of lamp | third type of lamp |
|---|---|---|---|
| original structure | communication distance: 20 meters | communication distance: 11 meters | communication distance: 7 meters |
| external antenna | communication distance: 28 meters | communication distance: 28 meters | communication distance: 26 meters |

According to the aforementioned embodiments of the present invention, the antenna of the present invention extends outside the lamp, thus preventing the antenna from being interfered by the lamp cup or other metal casing, so as to increase a communication distance and a communication effect. In addition, the fixing member can be used to position the antenna, so that the exterior appearance of the lamp can be kept when the antenna is disposed outside.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A lamp assembly, comprising:

a light source substrate comprising a first surface, a second surface and a plurality of light sources, wherein the first surface is opposite to the second surface, and the light sources are disposed on the first surface;

a circuit board electrically connected to the light source substrate, wherein a transmitting and receiving module is disposed on the circuit board, and the transmitting and receiving module has an antenna;

a lamp cover covering the light sources, wherein the lamp cover has an outer surface, an inner surface and a through hole, the inner surface is opposite to the outer surface, and the through hole extends from the inner surface to the outer surface, wherein the antenna passes through the through hole and extends outside the outer surface of the lamp cover; and a fixing member disposed on the outer surface of the lamp cover, wherein the fixing member is configured to fix the antenna and comprises:

an extending portion parallel to the outer surface of the lamp cover, wherein the extending portion has an accommodating slot, and the accommodating slot is configured to accommodate the antenna; and a positioning post vertically disposed on the extending portion, wherein the positioning post is inserted into a positioning hole of the lamp cover.

2. The lamp assembly of claim 1, wherein the circuit board is disposed on the second surface of the light source substrate, and the antenna passes from the second surface to the first surface of the light source substrate and extends out from the first surface.

3. The lamp assembly of claim 1, wherein the lamp cover further comprises a plurality of lens disposed on the inner surface of the lamp cover, and the lens are corresponding to the light sources.

4. The lamp assembly of claim 1, wherein the lamp cover further comprises a sealer, and the sealer is disposed in the through hole and covers a portion of the antenna located in the through hole.

5. The lamp assembly of claim 1, wherein the transmitting and receiving module is a bluetooth module, a ZigBee module or a WiFi module.

6. A lamp, comprising:

a lamp cup having an accommodating space; and a lamp assembly, comprising:

a light source substrate disposed in the accommodating space, wherein the light source substrate comprises a first surface, a second surface and a plurality of light sources, and the first surface is opposite to the second surface, and the light sources are disposed on the first surface;

a circuit board disposed in the accommodating space, wherein the circuit board is electrically connected to the light source substrate, wherein a transmitting and receiving module is disposed on the circuit board, and the transmitting and receiving module has an antenna;

a lamp cover disposed on a top end of the lamp cup and covering the accommodating space, wherein the lamp cover has an outer surface, an inner surface and a through hole, the inner surface is opposite to the outer surface, and the through hole extends from the inner surface to the outer surface, wherein the antenna passes through the through hole and extends outside the outer surface of the lamp cover, and a fixing member disposed on the outer surface of the lamp cover, wherein the fixing member is configured to fix the antenna and comprises:

an extending portion parallel to the outer surface of the lamp cover, wherein the extending portion has an accommodating slot, and the accommodating slot is configured to accommodate the antenna; and a positioning post vertically disposed on the extending portion, wherein the positioning post is inserted into a positioning hole of the lamp cover.

7. The lamp of claim 6, wherein the circuit board is disposed on the second surface of the light source substrate, and the antenna passes from the second surface to the first surface of the light source substrate and extends out from the first surface.

8. The lamp of claim 6, wherein the lamp cover further comprises a plurality of lens disposed on the inner surface of the lamp cover, and the lens are corresponding to the light sources.

9. The lamp of claim 6, wherein the lamp cover further comprises a sealer disposed in the through hole and covering a portion of the antenna located in the through hole.

10. The lamp of claim 6, wherein the transmitting and receiving module is a bluetooth module, a ZigBee module or a WiFi module.

11. The lamp of claim 6, further comprising a lamp adapter disposed on a bottom end of the lamp cup, wherein the lamp adapter is electrically connected to the circuit board.

* * * * *